US008272939B2

(12) United States Patent
Leger

(10) Patent No.: US 8,272,939 B2
(45) Date of Patent: Sep. 25, 2012

(54) VIDEO WAGERING MACHINE INCLUDING A BONUS ROUND TERMINATION ENHANCEMENT

(75) Inventor: Francois Romeo Leger, Dieppe (CA)

(73) Assignee: Spielo Manufacturing ULC, Moncton, New Brunswick (CA)

( * ) Notice: Subject to any disclaimer, the term of this patent is extended or adjusted under 35 U.S.C. 154(b) by 941 days.

(21) Appl. No.: 11/983,492

(22) Filed: Nov. 9, 2007

(65) Prior Publication Data

US 2009/0124330 A1 May 14, 2009

(51) Int. Cl.
*A63F 9/24* (2006.01)

(52) U.S. Cl. ..... 463/20; 16/25

(58) Field of Classification Search ..... 463/16–20, 463/25–29

See application file for complete search history.

(56) References Cited

U.S. PATENT DOCUMENTS 6,033,307 A * 3/2000 Vancura ..... 463/20
6,296,251 B1 * 10/2001 Webb ..... 273/292
6,755,737 B2 * 6/2004 Jackson et al. ..... 463/16

* cited by examiner

*Primary Examiner* — Omkar Deodhar
(74) *Attorney, Agent, or Firm* — Sullivan & Worcester LLC; Christopher T. McWhinney

(57) ABSTRACT

A method and system are provided for providing a bonus round responsive to a bonus trigger in a wagering game. The method includes providing at least one bonus spin. The method includes awarding a prize associated with a bonus spin result. The method includes, responsive to a termination trigger occurring, awarding a termination bonus and terminating the bonus round.

25 Claims, 10 Drawing Sheets

VIDEO WAGERING MACHINE INCLUDING A BONUS ROUND TERMINATION ENHANCEMENT

BACKGROUND

A slot machine is a type of wagering game, often offered in casinos and other gambling establishments. Traditional slot machines are coin-operated machines with three or more reels, which spin when a lever on the side of the machine is pulled. The machines include a currency detector that validates currency inserted to play. The slot machine provides a spin of the reels, and a resulting spin result occurs. The spin result includes a set of symbols. The machine typically pays off based on patterns of symbols visible on the front of the machine when the reels stops.

A video lottery terminal ("VLT") is a gaming machine that allows gamblers to bet on the outcome of a video game, e.g., a video simulation of a traditional mechanical slot machine. The VLT may include a display such as an LCD screen and inputs to receive player instructions, and communicate with a centralized computer system that determines the outcome of each wager. VLTs may also be known as video gaming devices or video slot machines. Video lottery terminal functionality may also be provided on a conventional personal computer, cellular telephone, or other computer-based device, either using installed software, or with functionality provided via Internet downloads or web page portals.

To increase the excitement of video slot machine play to game gamblers, video slot machine games often provide bonus games. Some bonus games have been proposed which include an extended sequence of events, e.g., a simulated dice game potentially having multiple dice rolls, during which prizes are accumulated. These sequences of events, and the bonus round itself may be terminated by the occurrence of a termination event, e.g., rolling craps in the simulated dice game.

DETAILED DESCRIPTION

In some example embodiments of the present invention, a method and system are provided which may increase player excitement in a video slot machine wagering game, or in other wagering games which include a bonus round. A bonus round may be triggered by a bonus trigger within the regular slot machine game, e.g., the occurrence of a special bonus symbol. The bonus round may include a series of bonus plays, e.g., bonus spins, that award bonus prizes. Bonus rounds may be provided until a bonus termination trigger occurs. However, previous attempts to use a termination trigger, e.g., the roll of craps in a simulated dice game, generally involve an event perceived as a "loss" by the player. This may diminish a player's excitement and satisfaction at having received a bonus round play.

In contrast with previous bonus round termination conditions, some example embodiments of the present invention include termination triggers which may be combined with a termination prize, e.g., an additional award or the application of a multiplier to accumulated prizes won during the bonus round. This additional award, provided as part of the termination of the bonus round, may ameliorate the reduction in excitement caused by having a losing event trigger the end of the bonus round.

At the same time, the use of a triggering event to terminate the bonus round allows the player to perceive there is the possibility that a potentially unlimited number of bonus spins may be awarded. In some example embodiments, this attribute may be further enhanced by requiring the termination event to occur multiple times before the bonus round is actually terminated, e.g., as described below, a special termination symbol may need to occur three times before the bonus round is terminated.

Figure 1A:
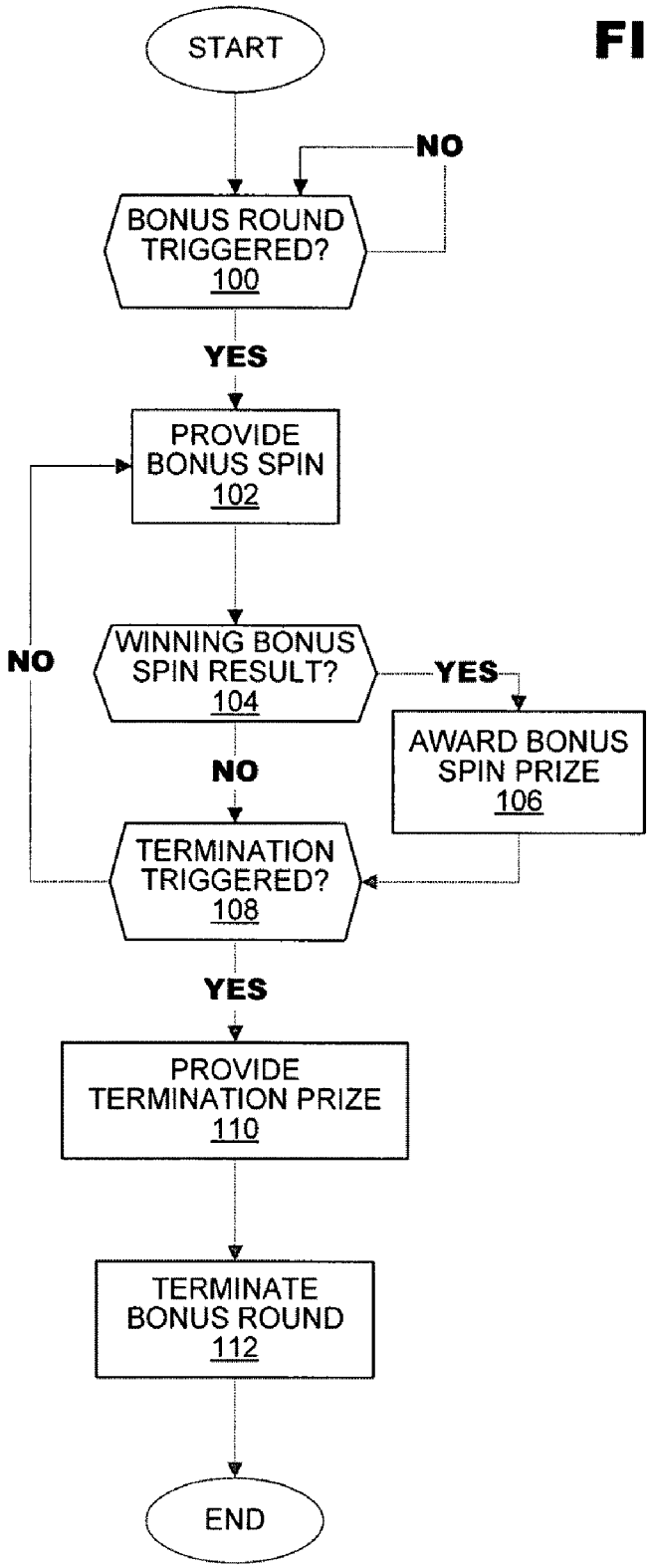
FIG. 1A illustrates a first example procedure for providing a wagering game, in accordance with a first example embodiment of the present invention.
Figure 3A:
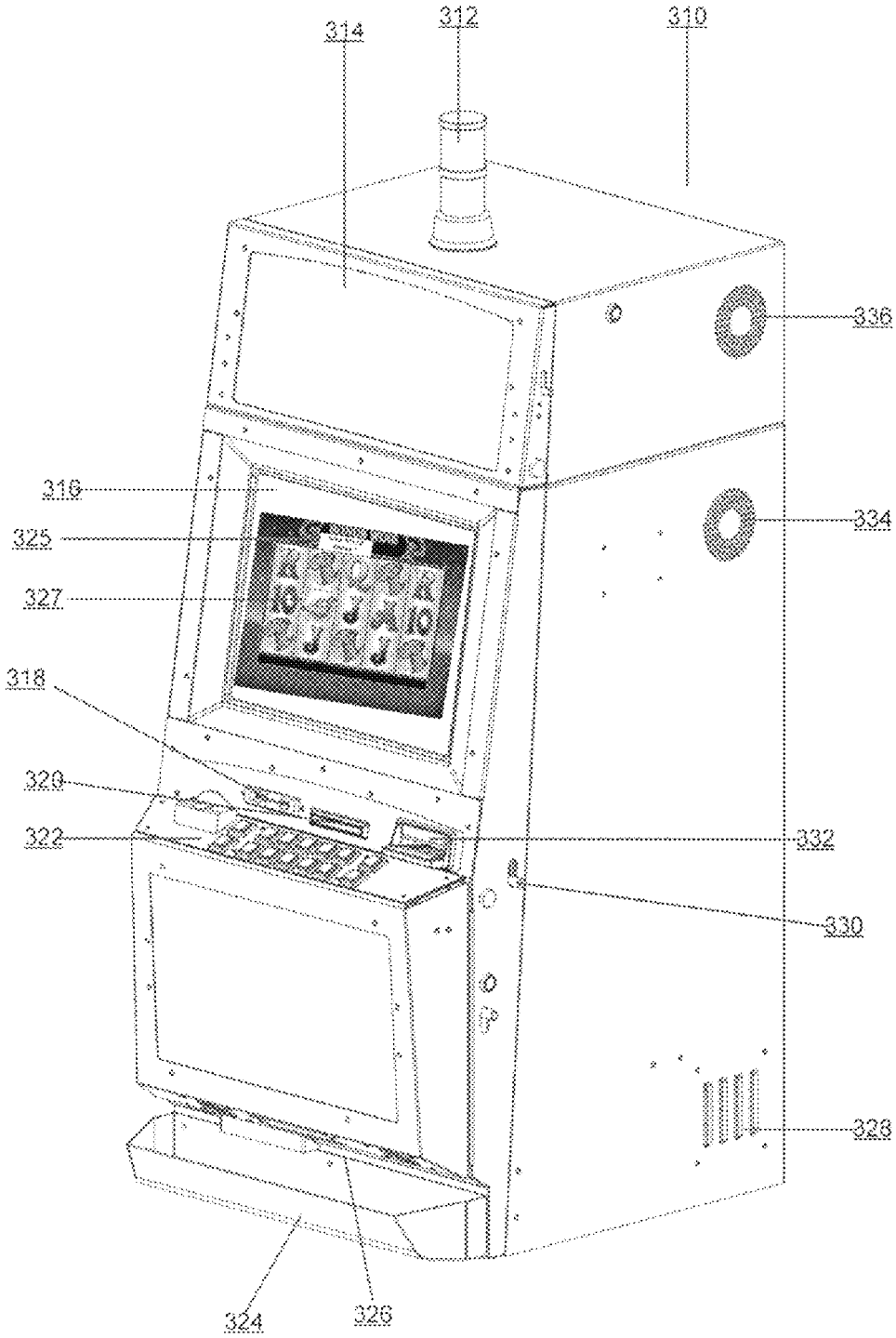
FIG. 3A illustrates an example video gaming machine, in accordance with an example embodiment of the present invention.

FIG. 1A illustrates a first example procedure for providing a wagering game, in accordance with a first example embodiment of the present invention. A video slot machine may be provided to a player, on a dedicated machine, on a networked slot machine operated using server-based gaming, or on a personal computer or other device that is programmed to function as a video slot machine using either software loaded on the machine or via an Internet connection with a server. It will be appreciated that the procedure may also be provided on a conventional slot machine using mechanical reels. The example procedure may execute on a VLT illustrated in FIG. 3 and provide screen shots illustrated in FIGS. 4A to 4E, or on other computer-based devices. A screenshot of a simulated regular slot machine game may be as illustrated in FIG. 4A.

Figure 4A:
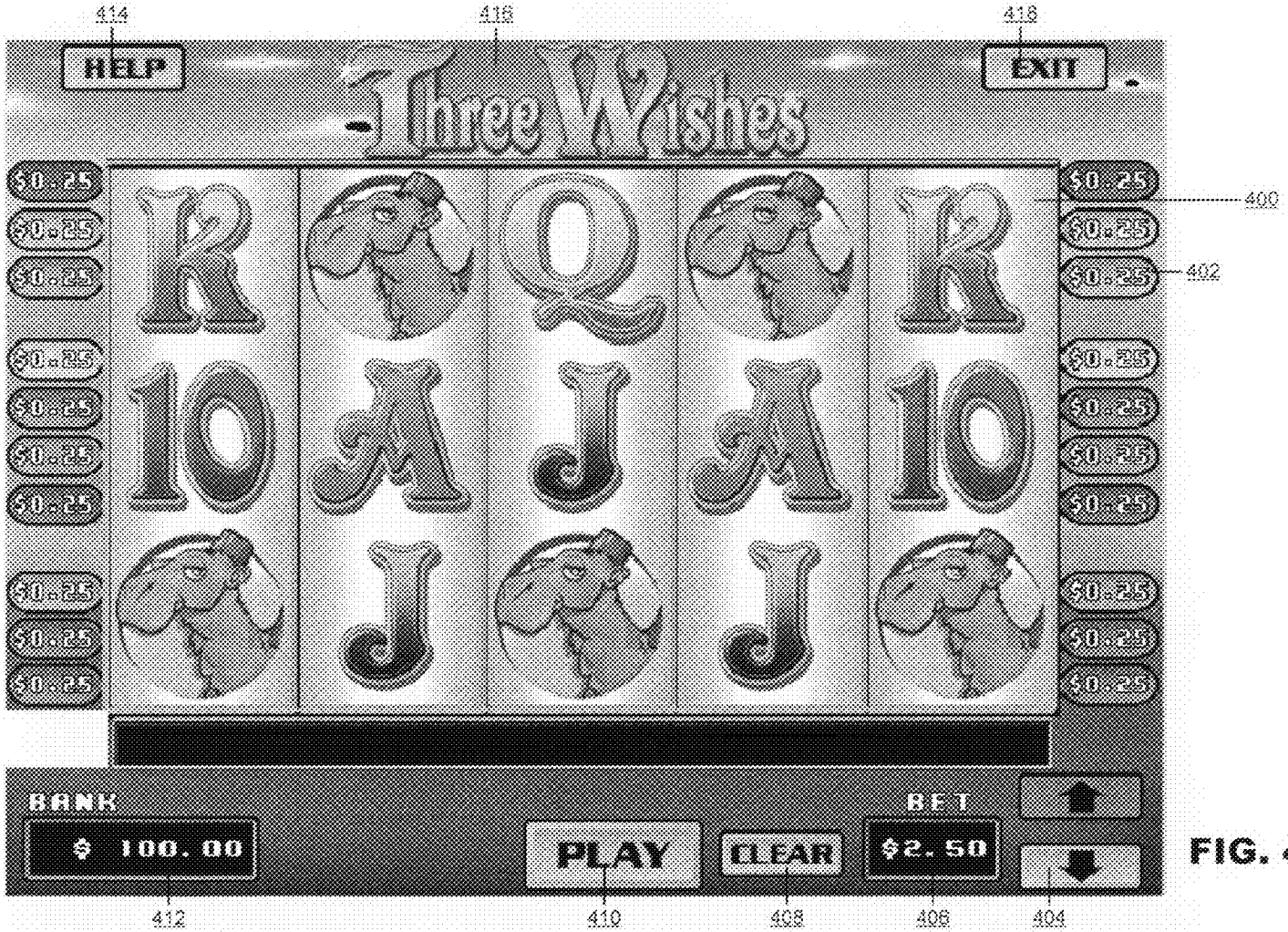
FIG. 4A illustrates a first example screen shot of the wagering game, in accordance with a first example embodiment of the present invention.
Figure 4B:
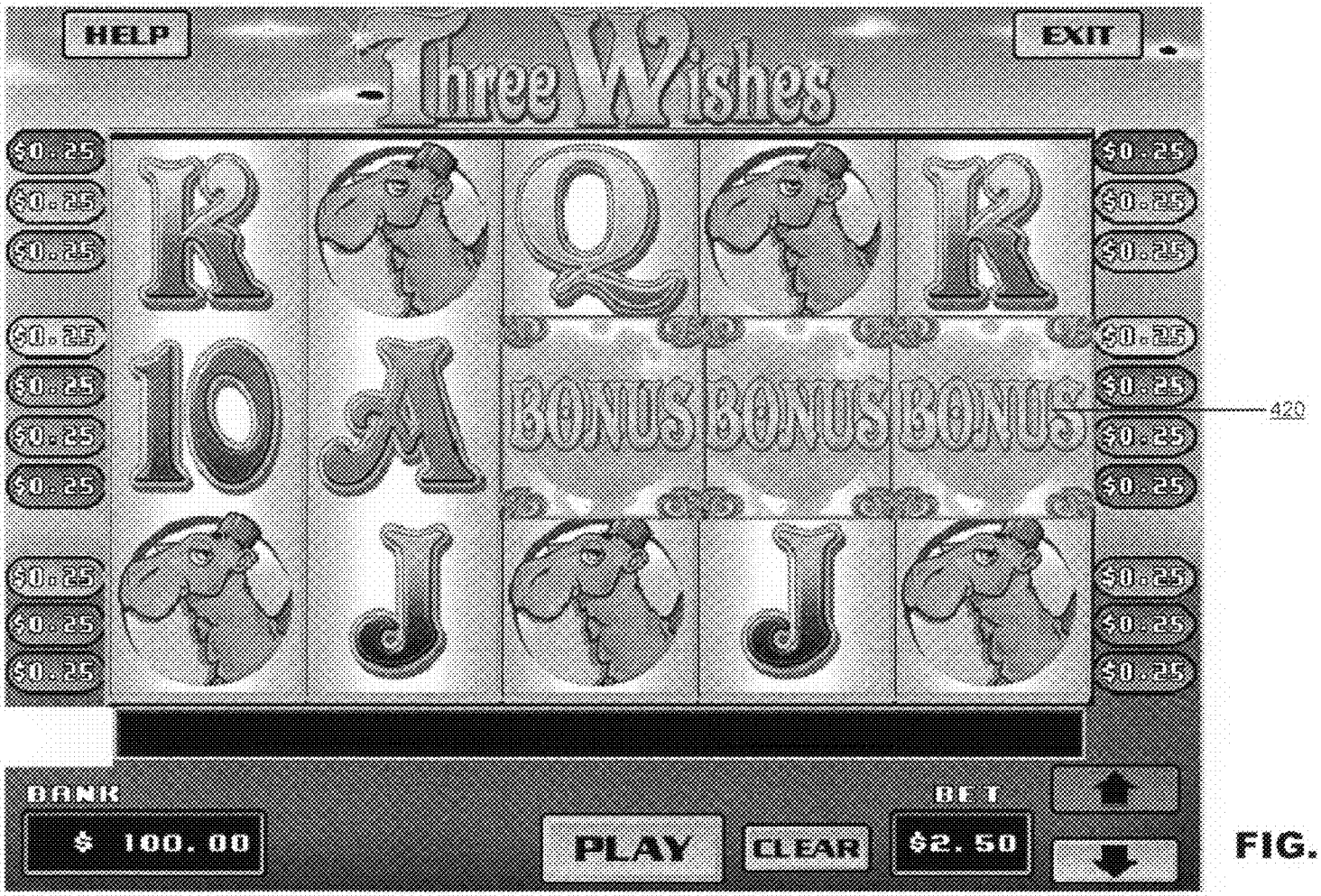
FIG. 4B illustrates a second example screen shot of the wagering game, in accordance with a first example embodiment of the present invention.

In 100, a bonus round may be triggered by a bonus trigger. For example, a bonus trigger may be an appearance of special symbols in a spin result of the slot machine game. If the bonus trigger occurs, the procedure proceeds to 102. If not, the regular slot machine game may continue. The bonus trigger may be as illustrated in FIG. 4B, a particular configuration of bonus symbols on the display, in this case three bonus symbols in the same row. It will be appreciated that any other condition may be utilized as a bonus trigger, for example, the display of a single bonus symbol, or a predetermined time interval elapsing since a last bonus round, or other predetermined events.

Figure 4C:
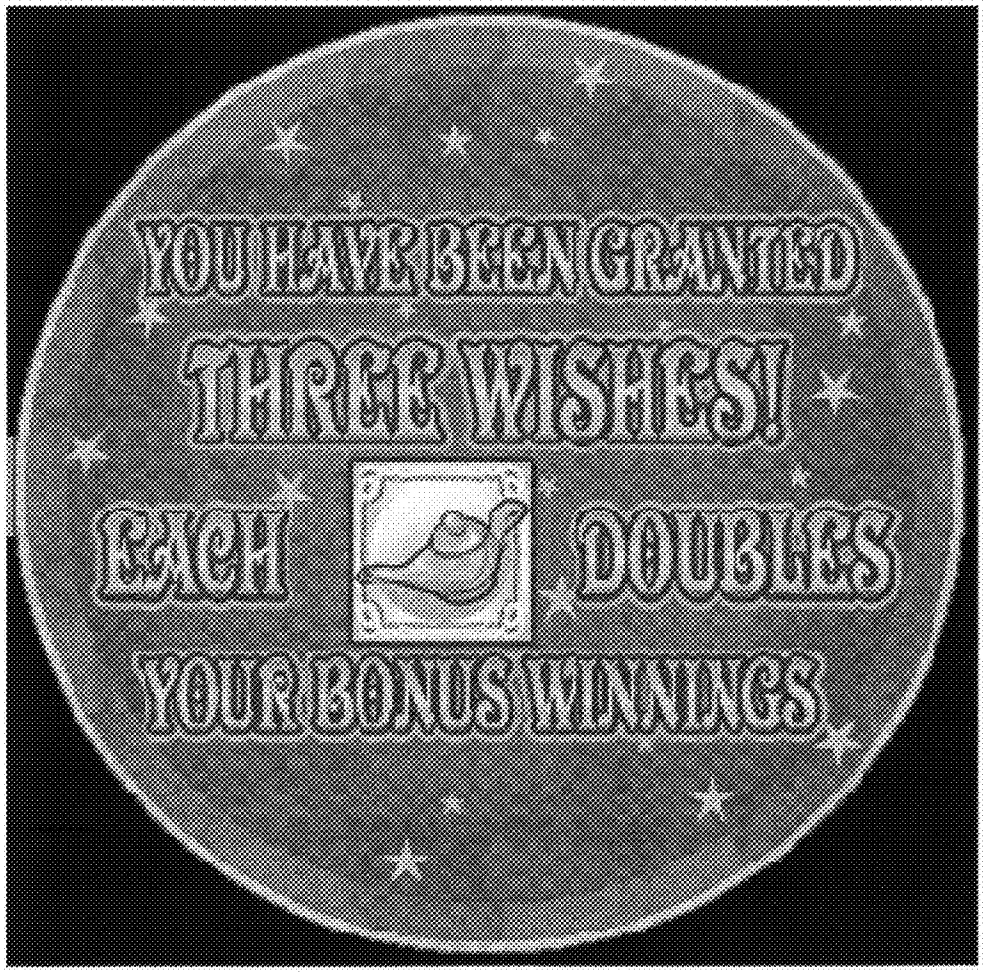
FIG. 4C illustrates a third example screen shot of the wagering game, in accordance with a first example embodiment of the present invention.

In 102, a bonus round has been triggered, and a bonus game may be provided to the player, e.g., in the form of a sequence of bonus spins. It will be appreciated that the bonus game may take other forms, e.g., rounds of a card game, dice rolling, or other sequences of events that can be recognized as winning or losing events according to the particular rules of the game. In the example procedure, the bonus spin is provided to the player. For example, a bonus spin may be similar to a regular spin in the slot machine game, and provide a bonus spin result, as discussed later. The VLT may display a transition screen before starting the bonus round. The transition screen may be as illustrated in FIG. 4C.

Figure 4D:
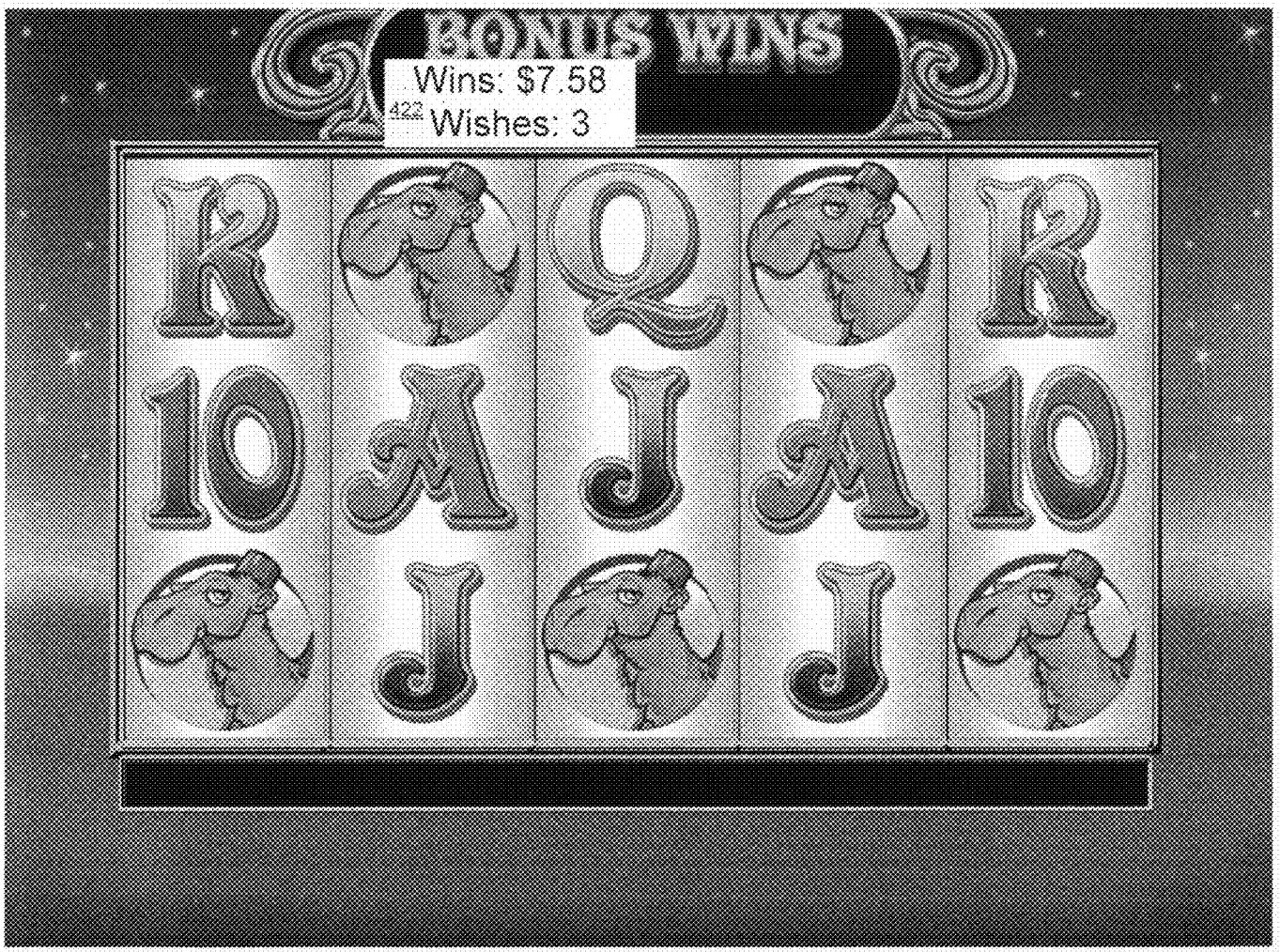
FIG. 4D illustrates a fourth example screen shot of the wagering game, in accordance with a first example embodiment of the present invention.

In 104, the VLT may test whether a winning spin result has occurred. For example, winning bonus spin results may be similar to winning spin results in the regular slot machine game. The winning spin result may include a set of predefined symbols appearing in the winning bonus spin result. If yes, a bonus spin prize is awarded in 106. If no, the procedure proceeds to 108. The bonus spin may be as illustrated in FIG. 4D.

In 106, a bonus spin prize is awarded to the player. For example, the bonus spin prize may be currency, game credits, prizes in kind, or any other prize that may be of value or interest to the player. The bonus spin prize may be associated with the bonus spin result of 104 in a prize table stored in the VLT or a central server.

Figure 4E:
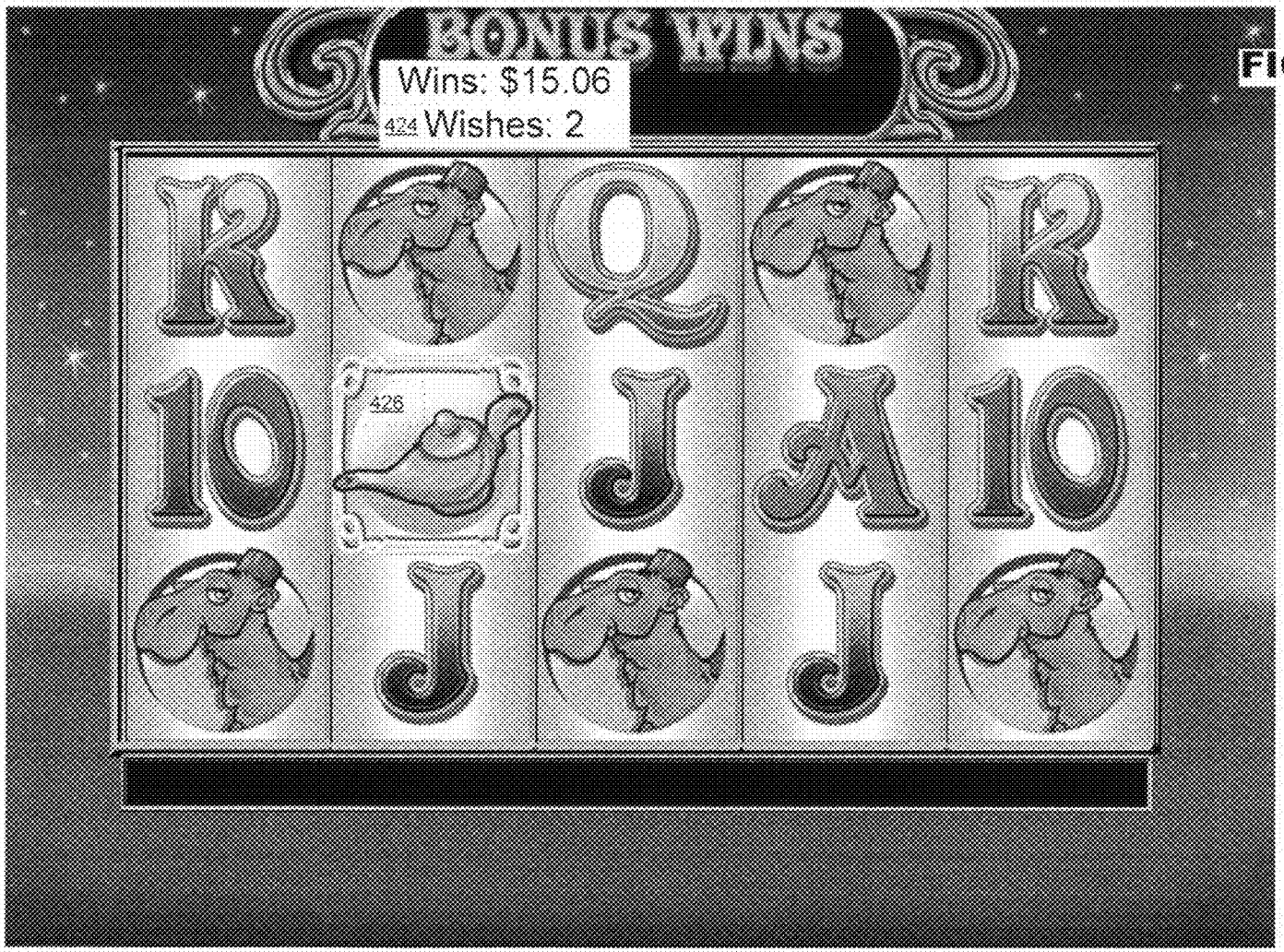
FIG. 4E illustrates a fifth example screen shot of the wagering game, in accordance with a first example embodiment of the present invention.

In 108, the VLT may test whether a termination trigger has occurred. For example, a termination trigger may be a predefined symbol appearing in the bonus spin result. In an alternative embodiment, the termination trigger may be a predefined symbol appearing a predefined number of times in a sequence of bonus spins. This may create a player perception that a potentially unlimited number of bonus spins may be awarded in the bonus round. The bonus spin result with a predefined symbol may be as illustrated in FIG. 4E.

In addition, the special symbol may be accompanied by a special prize, such as doubling any currency the player has won in the bonus round. This may increase player excitement in the wagering game, because even as the bonus round approaches its ending, a prize is awarded to the player. In an alternative embodiment, a fixed or variable prize may be awarded to the player as the special prize.

If the termination trigger has occurred, the procedure proceeds to 110. If not, the VLT provides another bonus spin in 102.

In 110, the VLT may provide a termination prize. For example, the termination prize may be all prizes won in the bonus round, which are credited to the player. In addition, a transition screen may be displayed as the bonus round ends.

In 112, the VLT may terminate the bonus round and return to regular slot machine play. A transition screen or sequence may be displayed to the player.

Figure 1B:
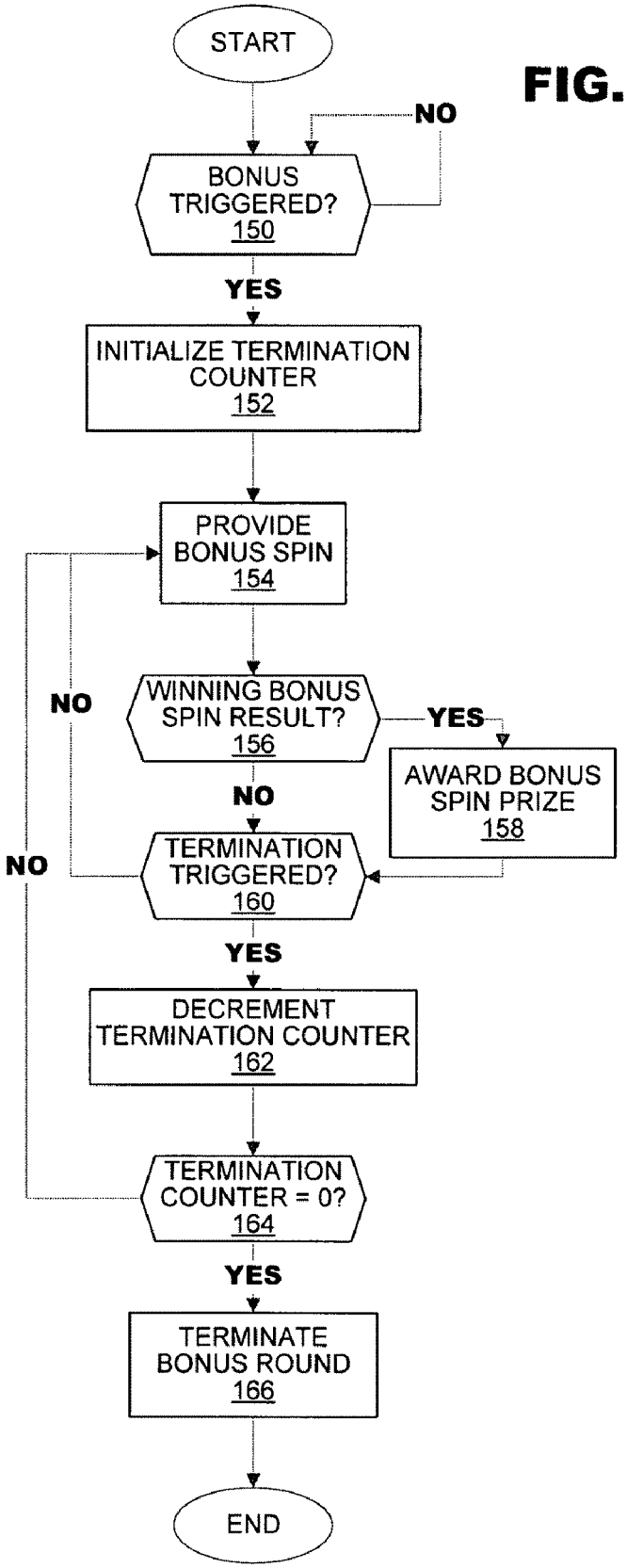
FIG. 1B illustrates a second example procedure for providing a wagering game, in accordance with a first example embodiment of the present invention.

FIG. 1B illustrates a second example procedure for providing a wagering game, in accordance with a first example embodiment of the present invention. Similar to the procedure in FIG. 1A, a regular slot machine game may be provided to a player, on either a VLT or a regular slot machine. The procedure may provide a bonus round and predefined number of termination bonuses during the bonus round. After the predefined number of termination bonuses have been provided, the bonus round may terminate.

In 150, the VLT may test whether a bonus trigger has occurred. As discussed above, a bonus trigger may be an appearance of a predefined bonus trigger symbol in a spin result of the slot machine game.

In 152, the VLT may initialize a termination counter. For example, the termination counter may be initialized to three, for three termination bonuses (discussed later) to be awarded in the bonus round. The bonus round may then begin.

In 154, a bonus spin may be provided to the player at the VLT. As discussed above, bonus spins may be similar to regular spins in the slot machine game.

In 156, the VLT may test whether a winning bonus spin result has occurred. A bonus spin result may be a winning bonus spin result if symbols appear in a predefined patter, as discussed above. If a winning bonus spin result has occurred the VLT proceeds to 158, where a bonus spin prize associated with the winning bonus spin result will be awarded. If no, the VLT proceeds to 160.

In 158, a bonus spin prize associated with the bonus spin result of 156 may be awarded to the player. For example, the bonus spin prize may be stored in a prize table at the VLT or a central server. For example, the bonus spin prize table may be the same prize table used in the regular slot machine game, necessitating only one prize table to be used.

In 160, the VLT may test whether a termination trigger has occurred. If yes, the VLT may proceed to 162. If no, the VLT may provide another bonus spin in 154.

In 162, the termination counter may be decremented. In one embodiment, the termination counter may be decremented by one. The termination counter may represent a remaining number of termination bonuses in the bonus round.

A termination bonus may be, for example, doubling the player's total accumulated winnings from the current bonus round. Alternative termination bonuses may include a variable or fixed currency or other consideration, free spins, free wild symbols on subsequent spins, or additional types of bonus plays, etc.

In 164, the VLT may test whether the termination counter is equal to zero. If yes, all termination bonuses have been awarded, and the VLT proceeds to 166. If no, additional terminal bonuses need to be awarded, and the VLT proceeds to 154.

In 166, the VLT may terminate the bonus round. A transition screen may be displayed before the regular slot machine game is again provided on the VLT.

Figure 2:
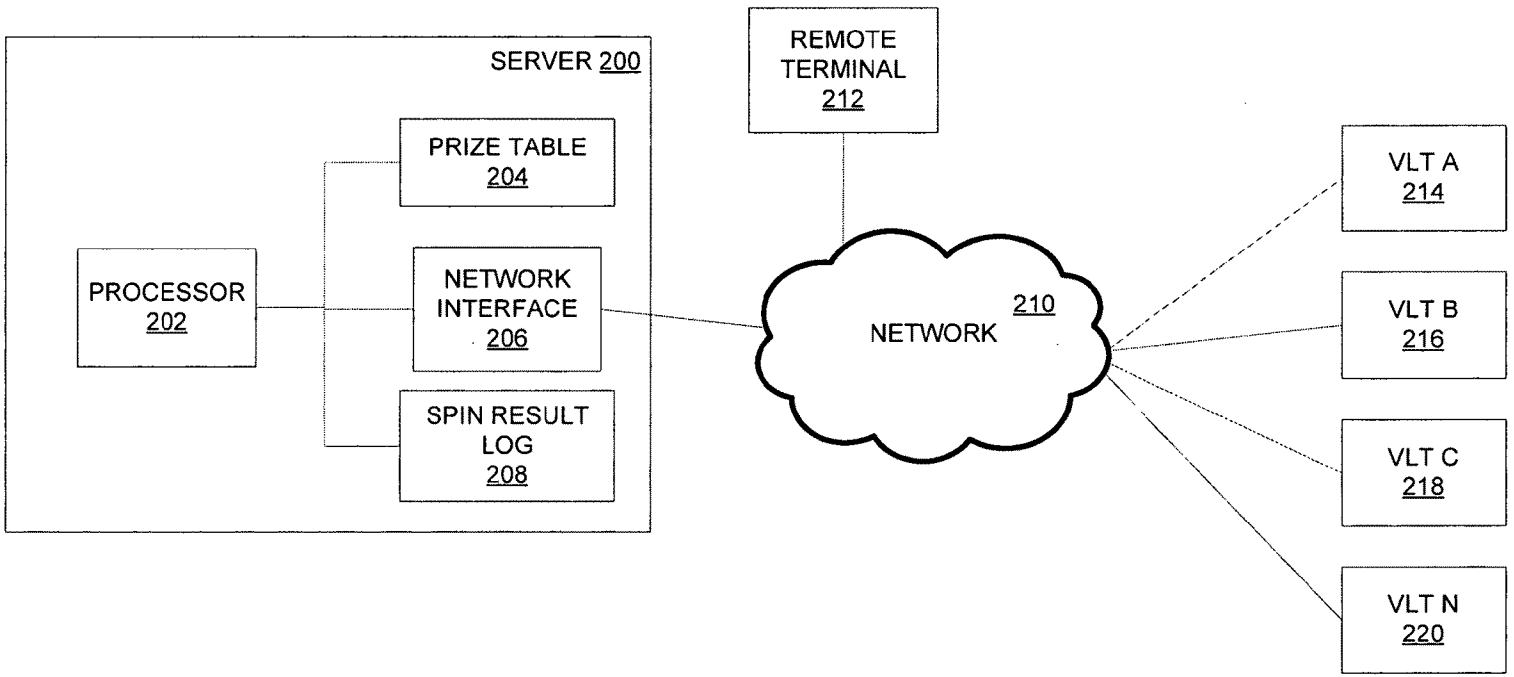
FIG. 2 illustrates an example system for providing a wagering game, in accordance with a first example embodiment of the present invention.

FIG. 2 illustrates an example system for providing a wagering game, in accordance with a first example embodiment of the present invention. The system may include a central server 200 and a plurality of VLTs for providing a wagering game as discussed elsewhere.

A server 200 may include a processor 202. The processor 202 may be configured to execute stored instructions for providing the wagering game. The processor 202 may access a prize table 204. The prize table 204 may associate spin results with prizes, both regular and bonus, as discussed elsewhere.

The server 200 may include a network interface 206. The network interface 206 may be configured to transmit and receive information to a network 210. The network 210 may be configured to carry digital information, and may be, for example, the Internet or a private network. The server 200 may include a spin result log 208. The spin result log 208 may log all spin results in the wagering game for audit purposes.

A remote terminal 212 may communicate with the server 200 over the network 210. For example, an administrator may access the server 200 from the remote terminal 212 for administrative tasks.

A plurality of VLTs 214, 216, 218, and 220 may communicate with the server 200 over the network 210. Each VLT may be as illustrated in FIG. 3. It will be appreciated that while only four VLTs are illustrated in FIG. 2, any number of VLTs may be used. Each VLT may be configured to provide a wagering game to a player. The VLTs may be located in geographically dispersed locations.

It will be appreciated that in the example procedures and systems described, outcomes may be determined as result of random determination of symbols displayed on a screen. However, as is commonly done in many video wagering machines, outcomes can also be determined randomly, e.g., by a random lookup in a prize table, and then an appropriate presentation may be created that corresponds to the determined outcome according to the rules of the games.

FIG. 3 illustrates an example video gaming machine, in accordance with an example embodiment of the present invention. A video gaming machine 310 may be configured to conduct a wagering game. For example, a wagering game may be a slot machine game, a lottery, a video game, or another game of chance involving a wager. For example, the video gaming machine 310 may be a VLT, a video slot machine, or a video game terminal. The video gaming machine 310 may be in communication with a server.

The video gaming machine 310 may include a blinker 312. The blinker 312 may enclose a light configured to blink on and off. For example, the blinker 312 may be configured to blink when a large prize is awarded from the video gaming machine 310 in the example bonus round of the game procedure described previously.

The video gaming machine 310 may include a lighted display 314. For example, the lighted display 314 may include a logo, a game name or other visually attractive graphics. The lighted display 314 may alternatively be a liquid crystal display screen. The display may be configured to operate under control of a processor located in the machine (not shown in the FIG. 3), or under the control of a remote processor. In particular, the screen may be configured under control of the processor to operate a video slot machine wager game including a bonus game having the features described in the present application, in particular the displays of the example procedures described in FIGS. 1A and 1B, and the example screen shots described below. Shown on the display on 314 is a set of simulated slot machine reels in a bonus game mode, which also includes the display of an accumulated bonus winnings and remaining bonus wins remaining until termination of the bonus round.

The video gaming machine 310 may include display screen 314. The display screen 314 may be a liquid crystal display screen or a CRT screen. For example, the display screen 314 may enclose a viewable display area visible to a player. The video display may be configured, under control of a processor to display a simulated video slot machine reel set as shown, as well as various bonus games. These bonus games may include termination triggering symbols, e.g., triggering symbol 327, as well as the display of register showing information such as the number of additional triggers required to terminate a bonus round, and the total accumulated winnings in the bonus round.

The video gaming machine 310 may include a credit card accepter 318, a player's card accepter 320 and a currency accepter 332. For example, the credit card accepter 318 may accept a credit card or a debit card for a player's wager. For example, the player's card accepter 320 may accept a frequent player's card. The frequent player's card may include a player's identifying information and wager history. Alternatively, the frequent player's card may include an identifier that is associated with a player's identifying information and wager history. The currency accepter 332 may be configured to accept cash bills in various denominations for a player's wager.

The video gaming machine 310 may include input devices 322. For example, the input devices 322 may be a set of buttons. The input devices 322 may be configured to receive input from a player during a wagering game.

The video gaming machine 310 may include a dispenser tray 324 and a dispenser 326. The dispenser 326 may be configured to dispense a prize. For example, a prize may be currency or a prize receipt redeemable at a cashier. The dispenser tray 324 may be configured to catch the prize after it is dispensed.

The video gaming machine 310 may include openings 328, 334 and 336. Opening 328 may be configured to allow ambient air to circulate into and out of an interior of the video gaming machine 310. Openings 334 and 336 may be configured to allow sound through.

Figure 3B:
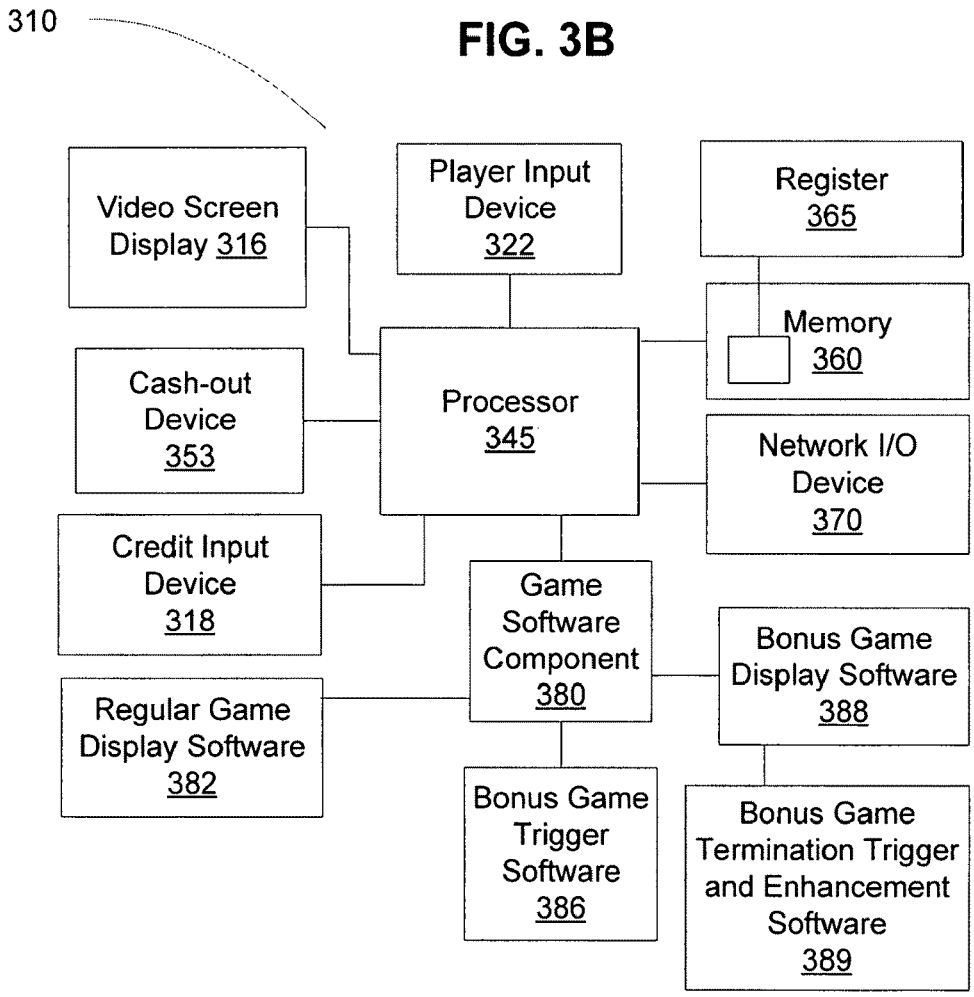
FIG. 3B illustrates a functional block diagram of the example video gaming machine, in accordance with an example embodiment of the present invention.

FIG. 3B illustrates a functional block diagram of the example video gaming machine, in accordance with an example embodiment of the present invention. The gaming machine 310 include a video screen display 316. The video screen display may display the game graphics and may have variable control settings. The video screen display may also have, for example, touch-screen buttons for player input. The gaming machine 310 may also include a player input device 322. The player input device 322 may be any device which allows the gaming terminal 310 to accept input from the user, for example, a conventional keyboard, an external number keypad, a pull lever, a joystick, a mouse, or the video display itself may accept touch-screen input. The gaming terminal 310 may also include a credit input device 318. The credit input device 318 may be designed, for example, to accept paper bills, or other slips detailing credit, or may be a device which reads magnetically or electronically stored information. Game machine 3310 may also include a processor 345. The processor 345 may be, for example, a CPU or microprocessor, or an embedded general purpose computer. The game machine 310 may also include a network I/O device 370. The network I/O device 370 may be, for example, a serial port which may connect to a telephone line, a USB port, or higher speed connection via a LAN or other network. The game terminal 310 may also include memory 360 to store the various graphics and instructions required to operate video screen display 116. Memory 360 may also allocate space for a register 365 to keep track of some value or set of values during game play, in particular the number of bonus triggers which a player must still receive to terminate a bonus round, as described the in the example procedures discussed previously. Alternatively, register 145 may be a separate piece of hardware, independent of the main set of memory 360.

The example gaming machine 310 may also include a game software component 380. The game software component may contain instructions for executing the game methods described above and below. The game software component 380 may be stored in memory 360, on a server, a disk, or any other device capable of being accessed by processor 345. The game software component 380 may have software to display a regular game 382. The regular game display software may have software to display an enhancement indicator 154 (e.g. the example of FIG. 6). The game software component 382 may have bonus game triggering software 386. The game software component 380 may have bonus game display software 388, which may be executed responsive to the bonus trigger 386. The bonus game display software 388 may have a software component 389 that triggers the termination of the bonus game and enhancement of the bonus prize upon such termination. It should be appreciated that any of these software components 380-389 may be directly accessible by the processor 345, accessible remotely through the network I/O device 370, accessible through the memory 360 (as being stored in memory 360), or through any other device capable of being accessed by the processor 345 (e.g., a disk and disk-drive). The software components 380-389 may be integral parts of the game software component 380, or may be independent components accessible by processor 380.

FIG. 4A illustrates a first example screen shot of the wagering game, in accordance with a first example embodiment of the present invention. The screen shot may be provided in a wagering game, as discussed above, and depict a spin result in the slot machine game. A set of symbols 400 may be displayed to the player. The symbols 400 may simulate five reels of a slot machine, each displaying three symbols. The symbols may be predefined, and predefined winning patterns of symbols may be associated with prizes.

The symbols 400 may be associated with a set of pay lines. Each pay line may be associated with a pay line indicator 402, which indicates if associated pay line is active and a wager amount. For example, the player may selectively activate pay lines in the wagering game and vary the wager amount on each pay line.

Increase and decrease buttons 404 may allow the player to increase or decrease his wager. A bet indicator 406 may indicate the current total wager in the wagering game. A clear button 408 may clear all selected pay lines and wagers. A play button 410 may spin the reels responsive to a player indication of a desire to play the game. A bank 412 may indicate an amount of credits available to the player in the wagering game. For example, the player may deposit additional currency into the wagering game, or cash out. A help button 414 may display help screens to the player. A title 416 may display a graphic or title of the wagering game. An exit button 418 may allow the player to exit the current wagering game.

FIG. 4B illustrates a second example screen shot of the wagering game, in accordance with a first example embodiment of the present invention. FIG. 4B may be similar to FIG. 4A, except a predefined bonus pattern 420 has appeared. The bonus pattern 420 may be a bonus trigger, triggering a bonus round as discussed elsewhere.

FIG. 4C illustrates a third example screen shot of the wagering game, in accordance with a first example embodiment of the present invention. A transition screen may be displayed explaining rules of the bonus round. For example, the rules may be that there will be three termination bonuses awarded, each termination bonus doubling the player's bonus winning. After the third termination bonus has been awarded, a termination trigger occurs and terminates the bonus round.

FIG. 4D illustrates a fourth example screen shot of the wagering game, in accordance with a first example embodiment of the present invention. FIG. 4D may be similar to FIGS. 4A and 4B, but depict a spin result in a bonus round. A bonus winnings and termination bonuses remaining indicator 422 may indicate the bonus winnings so far awarded to the player and a number of remaining termination bonuses in the bonus round. The number of remaining termination bonuses may decrement every time a termination bonus is awarded. The bonus winnings may be incremented by a bonus prize amount when a bonus winning spin result occurs. The bonus winnings may be doubled when a termination bonus is awarded.

FIG. 4E illustrates a fifth example screen shot of the wagering game, in accordance with a first example embodiment of the present invention. FIG. 4E may be similar to FIG. 4D, but depict a termination bonus having been awarded. A bonus termination trigger symbol 426 may award the termination bonus, for example, doubling the bonus winnings. The indicator 424 may be updated to reflect the doubled bonus winnings and the decreased remaining termination bonuses.

Many possible variations of the above described example systems and procedures are possible. In an alternative example embodiment, prizes may be awarded when each termination trigger occurs, e.g., the lamps in the screenshots illustrated above, while only the occurrence of a predetermined number of termination triggers results in termination of the bonus round. Alternatively, each trigger may cause a multiplication of the pot, so that several triggers result in successive multiplications and a very large part, which increases player interest and excitement. In this example, or in other alternative example embodiments, the bonus prize may be seeded by an initial base bonus prize at the start of the bonus round. The regular bonus plays during the bonus round may also add to the accumulated bonus prize, on every play, or depending on the results of particular bonus plays. In addition to a cash prize, the bonus round prize may include additional bonus prizes, game credits, a prize or chance at a prize from a progressive jackpot or other things of value or entertaining to players. For example, some special bonus round results or termination triggers may have the effect of increasing the termination triggers required to complete the existing bonus round.

In addition to slot machine spin type games, it will be appreciated that many other bonus round games could be provided, e.g., simulated dice, roulette, or other casino games, simulated card games, pick a prize games where the player guesses among random boxes to choose a prize, etc.

As an alternative to triggering the prize directly from the termination triggers, in some embodiments prizes may also be triggered by the number of plays or spins that occur in the bonus round without a particular or the final termination trigger occurring. In this way the player gets a special prize associated with particularly long bonus rounds.

An example embodiment of the present invention may be a method of providing a bonus round responsive to a bonus trigger in a wagering game. The method may include providing at least one bonus spin. The method may include awarding a prize associated with a bonus spin result. The method may include responsive to a termination trigger occurring, awarding a termination bonus and terminating the bonus round. The wagering game may be a video slot machine played on a video lottery terminal. The termination bonus may be doubling a bank balance in the wagering game. The bonus trigger may be an appearance of a special element in a spin result of the wagering game. The termination trigger may be a predetermined number of termination symbols appearing in sequential bonus spins. The prize may be associated with the bonus spin result in a prize table. The prize table may be stored on a server. In one alternative embodiment, multiple triggers may give prizes, and the occurrence of multiple triggers may be required to terminate the bonus round.

Another example embodiment of the present invention may be a terminal for providing a wagering game. The terminal may include a display, the display configured to depict symbols. The terminal may include a processor. The processor may be configured to provide at least one bonus spin on the display. The processor may be configured to award a prize associated with a bonus spin result. The processor may be configured to responsive to a termination trigger occurring, award a termination bonus and terminating the bonus round. The terminal may be a video lottery terminal. The termination bonus may be doubling a bank balance in the wagering game. The bonus trigger may be an appearance of a special element in a spin result of the wagering game on the display. The termination trigger may be a predetermined number of termination symbols appearing in sequential bonus spins on the display. The prize may be associated with the bonus spin result in a prize table. The system may include a network connection to a server, wherein the prize table is stored on the server.

Another example embodiment of the present invention may be a computer-readable medium storing computer-readable instructions, the instructions which when executed cause a processor to perform a method for providing a wagering game. The method may include providing at least one bonus spin. The method may include awarding a prize associated with a bonus spin result. The method may include responsive to a termination trigger occurring, awarding a termination bonus and terminating the bonus round. The wagering game may be a video slot machine played on a video lottery terminal. The termination bonus may be doubling a bank balance in the wagering game. The bonus trigger may be an appearance of a special element in a spin result of the wagering game. The termination trigger may be a predetermined number of termination symbols appearing in sequential bonus spins. The prize may be associated with the bonus spin result in a prize table. The prize table may be stored on a server.

It will be appreciated that all of the disclosed methods, games, and procedures described herein can be implemented using one or more computer programs or components. These components may be provided as a series of computer instructions on any conventional computer-readable medium, including RAM, ROM, flash memory, magnetic or optical disks, optical memory, or other storage media. The instructions may be configured to be executed by a processor, which when executing the series of computer instructions performs or facilitates the performance of all or part of the disclosed methods, games, and procedures.

MODIFICATIONS

In the preceding specification, the present invention has been described with reference to specific example embodiments thereof. It will, however, be evident that various modifications, combinations and changes may be made thereunto without departing from the broader spirit and scope of the present invention as set forth in the claims that follow. The specification and drawings are accordingly to be regarded in an illustrative rather than restrictive sense.

The invention claimed is:

1. A method of facilitating the play of a wagering game on a game machine, comprising:

displaying a bonus trigger as part of a game result in the wagering game;

responsive to the display of the bonus trigger, providing a bonus round;

providing a plurality of bonus game results in the bonus round;

awarding a bonus prize associated with a plurality of the bonus game results;

displaying a termination symbol in some plurality of the bonus game results;

responsive to each termination symbol, awarding a bonus multiplier, wherein the bonus multiplier is a multiplier to an accumulated balance in the bonus round, and responsive to a termination trigger occurring, terminating the bonus round and awarding a termination bonus.

2. The method of claim 1, wherein the wagering game is played on a video slot machine and the game result is a display of a spin result of a set of animated slot machine reels.

3. The method of claim 2, wherein each bonus game result is a second display of at least one bonus spin result of a modified set of animated slot machine reels.

4. The method of claim 3, wherein the termination trigger is the occurrence of a termination symbol in at least two bonus game results.

5. The method of claim 1, wherein a termination trigger is the occurrence of a predetermined number of termination symbols appearing in the bonus game results.

6. The method of claim 2, wherein the bonus trigger is an appearance of a special element in the spin result.

7. The method of claim 2, wherein the termination bonus is determined applying a multiplier to the accumulated balance in the bonus game.

8. The method of claim 2, further comprising:

awarding a prize associated with the spin result in a prize table.

9. The method of claim 1, wherein the bonus prize is selected from a prize table.

10. The method of claim 1, further comprising:

accumulating a total bonus prize won during the bonus game;

wherein awarding the termination bonus includes applying a multiplier to the accumulated total bonus prize.

11. The method of claim 1, further comprising:

responsive to the occurrence of a first termination symbol during the bonus round, awarding a first bonus multiplier;

responsive to the occurrence of a second termination symbol during the bonus round, terminating the bonus round and awarding an additional bonus multiplier.

12. The method of claim 1, further comprising the step of displaying the number of termination symbols required to cause a termination trigger.

13. The method of claim 1, wherein the wagering game is played on a personal computing device, cellular telephone or other computer-based device.

14. The method of claim 1, wherein the wagering game is played on a personal computing device, cellular telephone or other computer-based device using installed software or software that is provided via an Internet connection with a server.

15. A non-transitory computer-readable medium storing computer-readable instructions, the instructions which when executed cause a processor to perform a method for providing a wagering game, the method comprising:

displaying a bonus trigger as part of a game result in the wagering game;

responsive to the display of the bonus trigger, providing a bonus round;

providing a plurality of bonus game results in the bonus round;

awarding a bonus prize associated with a plurality of the bonus game results;

displaying a termination symbol in some plurality of the bonus game results;

responsive to the termination symbol, awarding a bonus multiplier, wherein the bonus multiplier is a multiplier to an accumulated balance in the bonus round, and responsive to a termination trigger occurring, terminating the bonus round and awarding a termination bonus.

16. A system configured to provide a wagering game, comprising:

a display, the display configured to depict symbols indicating a game result in a wagering game; and a processor in communication with the display, the processor configured to cause the display to display a bonus trigger as part of the game result, responsive to the display of the bonus trigger, to cause the display to display a bonus round, to determine a plurality of bonus game results in the bonus round and to cause the display to display the plurality of bonus game results, to award a bonus prize associated with a plurality of the bonus game results, to cause the display to display a termination symbol in some plurality of the bonus game results, and responsive to the termination symbol, to award a bonus multiplier, wherein the bonus multiplier is a multiplier to an accumulated balance in the bonus round; and responsive to a termination trigger occurring, to terminate the bonus round and award a termination bonus.

17. The system of claim 16, wherein the display is part of a video slot machine, and the game result is a spin result of a set of animated slot machine reels output on the display.

18. The system of claim 16, wherein the bonus game result is at least one bonus spin result of a modified set of animated slot machine reels output on the display.

19. The system of claim 16, wherein the termination trigger is the occurrence of at least two termination symbols in the bonus game results.

20. The system of claim 16, wherein the termination trigger is the occurrence of a predetermined number of termination symbols appearing in the bonus game results.

21. The system of claim 16, wherein the bonus trigger is an appearance of a special element in the spin result.

22. The system of claim 16, wherein the processor is further configured to determine the termination bonus by applying a multiplier to an accumulated total bonus prize.

23. The system of claim 16, wherein the display is part of a personal computing device, cellular telephone or other computer-based device.

24. The system of claim 16, wherein the processor provides functionality via installed software or software from one or more Internet downloads.

25. The system of claim 16, wherein the processor provides functionality via one or more web page portals.

* * * * *